US005382322A

United States Patent [19]

Magnotta et al.

[11] Patent Number: 5,382,322

[45] Date of Patent: Jan. 17, 1995

[54] SELECTIVE WHITE LIQUOR OXIDATION

[75] Inventors: Vincent L. Magnotta, Wescosville; Ronald C. Naddeo, Kempton; Varin Ayala, Catasauqua; John F. Cirucci; Virgil G. Fox, Jr., both of Allentown, all of Pa.

[73] Assignee: Air Products and Chemicals, Inc., Allentown, Pa.

[21] Appl. No.: 780,681

[22] Filed: Oct. 18, 1991

[51] Int. Cl.[6] ..... D21C 11/04

[52] U.S. Cl. ..... 162/30.11; 162/29; 162/239; 422/185; 423/514; 423/551; 423/DIG. 3

[58] Field of Search ..... 162/29, 30.11, 239; 422/185; 423/182, 183, 514, 551, DIG. 3

[56] References Cited

U.S. PATENT DOCUMENTS

| | | | |
|---|---|---|---|
| 3,655,343 | 4/1972 | Galeano | 162/31 |
| 3,997,300 | 12/1976 | Boatwright et al. | 162/30.11 |
| 4,053,352 | 10/1977 | Hultman et al. | 162/29 |
| 4,098,639 | 7/1978 | Noreus et al. | 162/30.11 |
| 5,082,526 | 1/1992 | Dorris | 162/30.11 |
| 5,143,702 | 9/1992 | Der et al. | 162/30.11 |

FOREIGN PATENT DOCUMENTS 1146345 3/1985 U.S.S.R. .

OTHER PUBLICATIONS

Ulmgren, Per., "The Manufacture of Sulfur-Free alkali in a Kraft Pulp Mill", Nordic Pulp & Paper Research Journal, No. 4, 1988, pp. 191–197.

Ronald McDonald, "The Pulping of Wood", vol. I, 1969, McGraw Hill Book Company, pp. 600–601.

"Airco Tech Topics" Airco Gases, Mar. 1990.

Baczynska, J.; "Use of White and Green Liquors as Alkalis in the Oxygen Stage of Kraft Pulp"; *Przeglad Papier*35; No. 6; Jun. 1979; pp. 193–195.

Novikova, AI et al; "Oxidation of White Liquor by Oxygen"; *Khim. Tekhnol Ee Prorzdnykh;* 1985; pp. 49–52.

*Primary Examiner*—W. Gary Jones

*Assistant Examiner*—Dean T. Nguyen

*Attorney, Agent, or Firm*—John M. Fernbacher; William F. Marsh

[57] ABSTRACT

A method for white liquor oxidation in a kraft mill utilizes a two-stage selective oxidation system in which the first stage is operated to remove sulfide while the second stage is operated to oxidize a significant fraction of the remaining oxidizable sulfur compounds to sulfate. The resulting selectively oxidized white liquor products are used as alkali sources for various process steps in the mill. Optionally, white liquor can be oxidized in a single stage to convert a significant fraction of the oxidizable sulfur compounds to sulfate. Methods for controlling the selective oxidation process are disclosed.

5 Claims, 10 Drawing Sheets

SELECTIVE WHITE LIQUOR OXIDATION

TECHNICAL FIELD

The present invention is directed towards white liquor oxidation in kraft pulp mills, and in particular towards selective oxidation to produce partially oxidized and fully oxidized white liquor.

BACKGROUND OF THE INVENTION

The sulfate or kraft process is widely used in the pulp and paper industry to convert wood chips into partially delignified cellulose pulp which is used directly in unbleached board and other unbleached paper products, or which is further delignified and bleached for making high brightness paper products. In this well-known process, the chips are converted into pulp at elevated temperatures by chemical delignification using an aqueous solution known as white liquor which contains sodium hydroxide, sodium sulfide, and other dissolved salts. The spent liquor from this process step, known as weak black liquor, contains residual organics, dissolved lignin, and other wood constituents. This weak black liquor is concentrated by evaporation, at which point soaps, resin salts, and fatty acids are recovered. The resulting strong black liquor is further evaporated, sodium and sulfur in various chemical forms are added as needed to replace sulfur losses in the process, ant the mixture is combusted in a recovery furnace to yield molten sodium sulfide and sodium carbonate; this molten material is then dissolved in water to give an aqueous solution known as green liquor. The green liquor is causticized with calcium oxide (lime) to convert the sodium carbonate to sodium hydroxide (caustic), which yields white liquor for use in another pulping cycle.

White liquor is a potential source of alkali for certain process steps in a kraft pulp mill except for the presence of sodium sulfide in the white liquor, which is undesirable in most applications. It has become common practice in kraft mills to oxidize white liquor with air to remove most of the sodium sulfide by conversion to partially oxidized sulfur compounds comprising mostly sodium thiosulfate. This yields an aqueous alkali, commonly known as oxidized white liquor, which contains sodium hydroxide and sodium thiosulfate as the major constituents with lesser amounts of sodium carbonate, sodium sulfite, and sodium sulfate, and which contains low levels of undesirable sodium sulfide. Oxidized white liquor as defined above is widely used as an alkali source in oxygen delignification, a process step which removes additional lignin from kraft pulp to produce a higher brightness pulp. The use of oxidized white liquor helps to maintain the balance of sodium and sulfur in the pulp mill because the residual alkali from oxygen delignification is returned to the white liquor cycle. Oxidized white liquor as defined above also can be used in gas scrubbing applications, for removal of residual chlorine or chlorine dioxide from bleach plant effluents, in the regeneration of ion exchange columns, and for the neutralization of various acidic streams in the pulp mill. Oxidized white liquor as described above generally cannot be used in bleaching stages which utilize peroxide, hypochlorite, or chlorine dioxide because the partially oxidized sulfur compounds consume additional bleaching chemicals in a given stage or in subsequent stages, thus rendering the use of oxidized white liquor uneconomicai in such applications. Oxidized white liquor as defined above also cannot be used as an alkali source for the production of sodium hypochlorite from chlorine and sodium hydroxide, since thiosulfate reacts with chlorine and sodium hypochlorite.

In current kraft pulp mill operation, the term white liquor oxidation means the oxidation of white liquor using air or oxygen to destroy sodium sulfide by converting most of the sulfide to sodium thiosulfate. U.S. Pat. No. 4,053,352 discloses a method of oxidizing white liquor with an oxygen-containing gas, preferably air, to convert practically all sulfides to thiosulfate. Oxidation is carried out by injecting air into white liquor in a tank at a flow rate of 50 to 500 $Nm^3/(hr\text{-}m^2)$ whereby the air provides oxygen and agitates the liquid to promote mixing. Oxidation is carried out between about 50° C. and 130° C. at a pressure up to 5 bars above atmospheric pressure. The use of oxidized white liquor as a source of alkali is disclosed, including applications in the steps of oxygen bleaching, flue gas scrubbing, chlorine bleaching, treating of waste gases from bleaching processes to destroy chlorine or chlorine dioxide, regenerating ion exchange columns, and neutralizing acidic liquids. Several process steps are defined for which oxidized white liquor cannot be used as an alkali source, such as peroxide bleaching and in the manufacture of hypochlorite.

In an article entitled "Use of White and Green Liquors as Alkalis in the Oxygen Stage of Kraft Pulp. (1) Oxidation of White and Green Liquors" published in *Przeglad Papier* 35, No. 6, June 1979, pp. 193–195, K. Baczynska reports results of a study on the oxidation of these liquors. The study found that the main oxidation product of sulfide contained in these liquors is thiosulfate; depending on the conditions of reaction, nearly complete oxidation (99.8%) of sulfide is possible but requires up to 5 hours of reaction time. In the presence of pulp in an oxygen bleaching reactor, sulfide oxidizes essentially to sulfate and very small amounts of sulfite and thiosulfate. The article teaches that white liquor oxidation to predominantly thiosulfate can be accomplished batchwise in a glass column at temperatures between 40° C. and 80° C. using a contacting time of 1.5 to 8 hours.

Soviet Union Patent SU 1146345 A discloses the oxidation of white liquor with a gas containing oxygen with addition or spent alkali from an oxygen bleaching stage to increase the rate of oxidation. Complete oxidation of sulfide occurs in 40 minutes at 90° C. under an oxygen pressure of 0.2 MPa compared with 60 minutes when no oxygen bleaching spent alkali is added. The products formed by the oxidation of sulfide are not described.

A. I. Novikova et al in an article entitled "Oxidation of White Liquor by Oxygen" in *Khim. Tekhno Ee Prorzdnykh* 1985, pp. 49–52, describe the reaction paths of sulfide oxidation in white liquor using oxygen or air. It is postulated that the sulfide first oxidizes rapidly to polysulfide ($Na_2S_x$), sulfite, and thiosulfate. Subsequent oxidation of intermediate species to sulfate occurs slowly and catalysts are required to accelerate the reaction. Partially oxidized white liquor containing polysulfides is said to accelerate delignification when used as an alkali for delignification and bleaching; for this reason oxidation to sulfate is stated to be undesirable. Specific operating conditions for white liquor oxidation are not disclosed.

The use of pure oxygen instead of air for white liquor oxidation is described in a brochure entitled "AIRCO Tech Topics" by Airco Gases, March 1990. A pressurized pipeline reactor with recycle is disclosed for the oxidation of sodium sulfide in white liquor to sodium thiosulfate and sodium hydroxide. It is stated that the oxidation chemistry is the same whether using air or pure oxygen and that both produce a sodium thiosulfate product.

The background art summarized above thus discloses the oxidation of white liquor to destroy sulfide by conversion to a partially oxidized intermediate product comprising mostly thiosulfate. In addition, uses of such an oxidized white liquor as an alkali source in certain process steps in a kraft pulp mill are described. However, other applications are listed in the background art in which such an oxidized white liquor cannot be used as an alkali source, chiefly because it contains thiosulfate which consumes the oxidizing compounds used for bleaching kraft pulp. Specific methods to produce and use an oxidized white liquor which is free of significant amounts of thiosulfate or other partially oxidized sulfur compounds are not known or described in the current background art.

The invention disclosed in the following specification and defined in the appended claims offers methods for the selective oxidation of white liquor and the use of different selectively-oxidized white liquor products for improved kraft mill operation.

SUMMARY OF THE INVENTION

White liquor used in the kraft pulping process is selectively oxidized according to the present invention to remove sodium sulfide by conversion to partially-oxidized sulfur compounds chiefly comprising sodium thiosulfate to yield a partially oxidized white liquor, and by further oxidizing at least a portion of this product to convert at least a portion of the unoxidized or partially-oxidized sulfur compounds to sodium sulfate to yield a fully oxidized white liquor. Alternately, a white liquor stream can be divided and oxidized directly in parallel reaction zones to yield partially and fully oxidized white liquor steams. The invention thus allows production of two converted white liquor products containing different concentrations of oxidized and unoxidized sulfur compounds which can be utilized as alkali sources for selected processes in the kraft mill. Alternately, a single fully oxidized white liquor product can be provided by oxidizing white liquor with oxygen in a selected temperature range.

The degree of oxidation of each oxidized white liquor product is fixed by controlling the amount of oxygen introduced into each reaction zone as an oxygen-rich gas stream, and the volume of each reaction zone is minimized by the selection of an optimum temperature at the selected operating pressure.

DETAILED DESCRIPTION OF THE INVENTION

Figure 1:
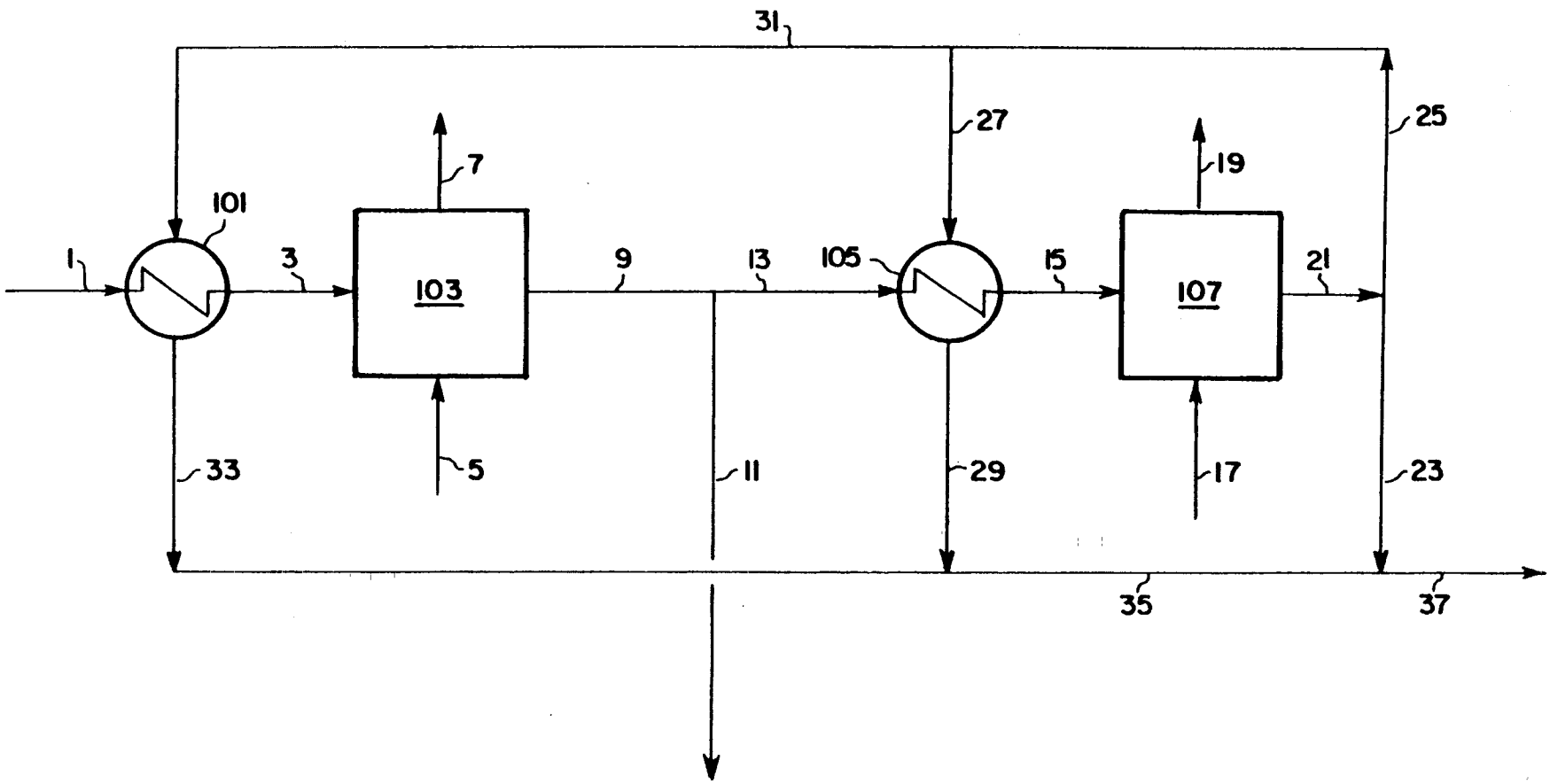
FIG. 1 is a schematic flow sheet of the process of the present invention.

The present invention is a method for the selective oxidation of white liquor in a pulp mill using the kraft wood pulping process. The method comprises the steps of (a) contacting an unoxidized white liquor feed stream comprising sodium sulfide, sodium hydroxide, and water with a first oxygen-rich gas stream in a first reaction zone at a temperature between about 180° F. and about 325° F. utilizing an oxygen supply rate and residence time sufficient to convert at least 80% of the sodium sulfide into one or more partially oxidized sulfur compounds and form a partially oxidized white liquor; (b) withdrawing from the first reaction zone at a portion of said partially oxidized white liquor as a partially oxidized white liquor product; (c) contacting the remainder of said partially oxidized white liquor with a second oxygen-rich gas stream in a second reaction zone at a temperature between about 300° F. and about 380° F. utilizing oxygen supply rate and residence time sufficient to convert at least 80% of all unoxidized and partially oxidized sulfur compounds contained therein into sodium sulfate; and (d) withdrawing from the second reactor a fully oxidized white liquor product.

In an alternate embodiment, the invention is a method for producing fully oxidized white liquor from a white liquor feed stream comprising one or more oxidizable sulfur compounds selected from the group consisting sodium sulfide, sodium sulfite, and sodium thiosulfate. The method comprises the steps of (a) contacting the white liquor feed stream with an oxygen-containing gas stream in a reactor at a temperature between about 180° F. and about 380° F. utilizing an oxygen supply rate and residence time sufficient to convert at least 80% of the oxidizable sulfur compounds into sodium sulfate; and (b) withdrawing from the reactor the fully oxidized white liquor product. The white liquor feed stream can be an unoxidized white liquor in which the molar ratio of sulfide to total sulfur is at least about 0.8; alternately the feed stream can be a partially oxidized white liquor in which the molar ratio of sulfide to total sulfur is less than about 0.2.

The invention is also a fully oxidized white liquor product made by (a) contacting a white liquor feed stream comprising one or more oxidizable sulfur compounds selected from the group consisting of sodium sulfide, sodium sulfite, and sodium thiosulfate with an oxygen-containing gas stream in a reactor at a temperature between about 180° F. and about 380° F. utilizing an oxygen supply rate and residence time sufficient to convert at least 80% of said oxidizable sulfur: compounds into sodium sulfate; and (b) withdrawing from the reactor the fully oxidized white liquor product.

In an alternate mode, the invention is a method of controlling the operation of a selective white liquor oxidation reaction system in a kraft pulp mill. This is accomplished by (a) selecting the individual flow rates of partially oxidized and fully oxidized white liquor products required in the mill; (b) determining the maximum allowable sulfide concentration in the partially oxidized white liquor product and the maximum allowable concentration of oxidizable sulfur compounds in the fully oxidized white liquor product; (c) introducing a feed stream of unoxidized white liquor into a first reaction zone and contacting the stream with a first stream of oxygen-rich gas which is controlled at a first flow rate sufficient achieve the maximum allowable sulfide concentration while minimizing oxygen consumption, thereby forming a partially oxidized white liquor, wherein the flow rate of this feed stream is equal to the total flow of the partially oxidized and fully oxidized white liquor products; (d) withdrawing a portion of said partially oxidized white liquor from the first reaction zone as a partially oxidized white liquor product; (e) introducing the remainder of said partially oxidized white liquor into a second reaction zone and contacting it with a second stream of oxygen-rich gas which is controlled at a second flow rate sufficient achieve the maximum allowable concentration of oxidizable sulfur compounds while minimizing oxygen consumption; and (f) withdrawing a stream of fully oxidized white liquor product from the second reaction zone.

In a related alternate mode, the invention is a method of controlling the operation of a single stage selective white liquor oxidation reaction system in a kraft pulp mill. This method comprises (a) selecting the flow rate of oxidized white liquor required in the mill; (b) determining the maximum allowable sulfide concentration and the maximum allowable concentration of oxidizable sulfur compounds in the oxidized white liquor; (c) introducing a feed stream of unoxidized white liquor into a reaction zone and contacting it with a stream of oxygen-containing gas which is controlled at a flow rate sufficient achieve the maximum allowable sulfide concentration and maximum allowable concentration of oxidizable sulfur compounds while minimizing oxygen consumption; and (d) withdrawing a stream of oxidized white liquor from the reaction zone.

The invention includes an alternate method for the selective oxidation of white liquor in a kraft mill to produce two oxidized white liquor products. This alternate method comprises (a) dividing an unoxidized white liquor feed stream comprising sodium sulfide, sodium hydroxide, and water into a first and a second feed stream; (b) contacting this first feed stream with an oxygen-rich gas stream in a first reaction zone at a temperature between about 180° F. and about 325° F. utilizing an oxygen,supply rate and residence time sufficient to convert at least 80% of the sodium sulfide into one or more partially oxidized sulfur compounds; (c) withdrawing from the first reaction zone a partially oxidized white liquor product; (d) contacting the second feed stream with an oxygen-containing gas stream in a second reaction zone at a temperature between about 300° F. and about 380° F. utilizing an oxygen supply rate and residence time sufficient to convert at least 80% of all unoxidized and partially oxidized sulfur compounds contained therein into sodium sulfate; and (e) withdrawing from the second reaction zone a fully oxidized white liquor product.

In the background art summarized above, the term white liquor oxidation pertains to the oxidation of sodium sulfide to partially oxidized sulfur compounds, predominantly sodium thiosulfate. The objective of the oxidation is solely to destroy sodium sulfide. The term oxidized white liquor as used in the background art refers to the product of such an oxidation process. In the present specification and appended claims, different terms are used to describe various white liquors and the meanings of these terms are defined as follows. White liquor (WL) is defined as a relatively unoxidized aqueous liquor typically containing sodium hydroxide, sodium sulfide as the major dissolved constituents, an intermediate amount of sodium carbonate, and minor concentrations of sodium sulfite, sodium thiosulfate, and sodium sulfate. White liquor also contains very low concentrations of soluble metals or metal salts derived from the wood chips fed to the pulping process. This white liquor is obtained by causticizing green liquor as earlier described, and typically the molar ratio of sulfide to total sulfur in the white liquor is greater than about 0.8, although it may be lower in some cases depending on actual mill operation. Oxidized white liquor (OWL) is a generic term which defines a white liquor which has been subjected to one or more oxidation steps. Partially oxidized white liquor is defined as white liquor in which at least 80% of the sodium sulfide originally present has been oxidized to yield predominantly sodium thiosulfate with smaller amounts of sodium sulfite, sodium polysulfide, and sodium sulfate, and is alternately defined herein as OWL(T). The molar ratio of sulfide to total sulfur in OWL(T) is generally less than about 0.2. Fully oxidized white liquor is defined herein as white liquor in which at least 80% of all unoxidized or partially oxidized sulfur compounds in partially oxidized white liquor have been converted to sodium sulfate, and is alternately defined herein as OWL(S). Fully oxidized white liquor made by the method of the present invention utilizing a typical mill white liquor feed will contain less than 15 g/l, preferably less than 10 g/l, and most preferably less than 5 g/l of oxidizable sulfur compounds. The term oxidizable sulfur compounds as used herein includes all unoxidized sulfur compounds (which comprise sulfide, polysulfide, and hydrosulfide compounds) and partially oxidized sulfur compounds (which comprise thiosulfate and sulfite compounds). The term oxygen-containing gas means any gas containing oxygen, such as for example air, enriched air, or high purity oxygen. The term oxygen-rich gas means a gas containing at least about 80 vol % oxygen.

The use of both OWL(T) and OWL(S) as sources of alkali in a kraft mill can improve operations by reducing requirements for fresh alkali and allowing closer sodium and sulfur balances in the mill. OWL(T) can be used as an alkali in oxygen delignification, in which additional lignin is removed from kraft pulp to produce a higher brightness pulp. The use of OWL(T) in this process helps to maintain the balance of sodium and sulfur in the pulp mill, and this benefit is expected to become more important in the future as mills eliminate chlorine-based bleaching sequences and replace them with peroxide, ozone, and other nonchlorine sequences. OWL(T) can be used in alkali extraction (E) or oxygen alkali extraction ($E_o$) stages, preferably if these stages are not followed by peroxide, hypochlorite, or chlorine dioxide bleaching stages. OWL(T) also can be used for gas scrubbing applications, for removal of residual chlorine or chlorine dioxide from bleach plant effluents, for the regeneration of ion exchange columns, and for the neutralization of various acidic streams in the pulp mill. In applications in which the OWL(T) will contact an acidic material, a sodium sulfide concentration of less than 0.5 g/l is typically required to avoid the release of any significant amounts of hydrogen sulfide. Sodium sulfide concentrations of less than 0.1 g/l are preferred in many applications; such concentrations are readily achieved by the method of the present invention, in contrast with present air oxidation methods which cannot practically achieve such low sulfide concentrations.

OWL(T) is generally not economical as an alkali source in processes which utilize oxidants which are more costly than oxygen, since the thiosulfate and other oxidizable sulfur compounds will consume a portion of these oxidants anti thus adversely affect process economics. Such processes include peroxide, ozone, hypochlorite, and chlorine dioxide bleaching stages, as well as peroxide-enhanced alkali extraction ($E_p$) and peroxide-enhanced oxidative extraction ($E_{op}$), in which relatively costly oxidative bleaching chemicals are utilized to remove residual lignin and color from pulp to be used in high quality paper products. OWL(T) also cannot be used as an alkali source for the production of sodium hypochlorite, since thiosulfate reacts with chlorine and sodium hypochlorite. For such applications, OWL(T) must be further oxidized to OWL(S) by converting a significant portion of the residual unoxidized or partially oxidized sulfur compounds to sodium sulfate. Practical methods for such further oxidation of white liquor to OWL(S) were not previously available and have not been described in the background art earlier described. The present invention allows the efficient oxidation of partially oxidized white liquor to a highly oxidized state for use in bleaching and in the production of sodium hypochlorite. In an alternate embodiment, the invention allows the efficient oxidation of relatively unoxidized white liquor to a highly oxidized state for use in bleaching and in the production of sodium hypochlorite.

The oxidation of sodium sulfide and other oxidizable sulfur compounds in aqueous solution with sodium hydroxide to final product of sodium sulfate proceeds through a number of reaction steps. The overall main reactions are $$2\,Na_2S + 2\,O_2 + H_2O \rightarrow Na_2S_2O_3 + 2\,NaOH \quad (1)$$

$$Na_2S_2O_3 + 2O_2 + 2NaOH \rightarrow 2Na_2SO_4 + H_2O \quad (2)$$

and several intermediate and competing reactions also occur as follows:

$$2Na_2S + \tfrac{1}{2}O_2 + H_2O \rightarrow Na_2S_2 + 2NaOH \quad (3)$$

$$Na_2S_2 + 3/2O_2 \rightarrow Na_2S_2O_3 \quad (4)$$

$$Na_2S_2O_3 + O_2 + 2NaOH \rightarrow 2Na_2SO_3 + H_2O \quad (5)$$

$$2Na_2SO_3 + O_2 \rightarrow 2Na_2SO_4 \quad (6)$$

$$2Na_2S + 2H_2O \rightarrow 2NaHS + 2NaOH \quad (7)$$

$$2NaHS + 3O_2 + 2NaOH \rightarrow 2Na_2SO_3 + 2H_2O \quad (8)$$

Other intermediate reactions have been postulated including the formation and direct oxidation of higher molecular weight polysulfides ($Na_2S_x$) to sodium thiosulfate and sodium hydroxide. These reactions are exothermic; heats of reaction for (1) and (2) above are −14,200 and −15,400 kJ/kg $O_2$ consumed respectively. The kinetics and reaction equilibria of these reactions have different temperature dependencies; in addition, temperature affects the solubility and mass transfer characteristics of oxygen in white liquor. The amount and partial pressure of oxygen in the reaction zone also will affect mass transfer rates and reaction equilibria. Further, these reactions are readily catalyzed by various impurities and compounds including those derived from wood in the pulping process. For these reasons, the prediction of white liquor oxidation reactor performance operating parameters from known background art is riot possible.

A schematic flow diagram for the process of the present invention is given in FIG. 1. In the primary mode of operation, white liquor feed stream 1 is optionally heated in exchanger 101 and flows as stream 3 into reaction zone 103. Stream 1 typically has a molar ratio of sulfide to total sulfur of at least about 0.8. Oxygen-rich gas stream 5, typically containing at least 80 vol % oxygen, is introduced into reaction zone 103 and contacted with the white liquor therein to selectively oxidize the sulfide to thiosulfate and other partially oxidized sulfur compounds while minimizing the consumption of oxygen to form sodium sulfate. This is accomplished by controlling the flow of stream 5 such that the molar ratio of oxygen therein to sodium sulfide in stream 1 is between about 1.0 and about 1.3, and by controlling the temperature in reaction zone 103. The temperature is controlled between about 180° F. to 325° F. in reaction zone 103 by controlling the flow of hot oxidized white liquor stream 31 through exchanger 101; the required flow of stream 31 will depend upon the sulfide concentration in stream 1, the temperature of stream 101, and other factors. Optionally, heat exchange may take place within reaction zone 103 after oxygen is in contact with the white liquor and the reaction has commenced. Optionally, other known means for adding heat to reaction zone 103 may be used. In certain cases, it is possible that the combination of a high sulfide concentration in stream 1 and a lower desired temperature in reaction zone 103 may require cooling rather than heating in exchanger 101. Alternately, it may be desirable to operate the reaction zone autothermally by neither heating nor cooling stream 1, in which case the temperature in the reaction zone will reach a level determined by the heat of reaction and the heat leak characteristics of the reaction system. At least 80% and preferably 95% of the sulfide in stream 1 is converted to partially oxidized sulfur compounds, chiefly sodium thiosulfate. Unconsumed oxygen, inert gases, and steam may be vented from the reaction zone in stream 7.

Partially oxidized white liquor stream 9 is withdrawn from reaction zone 103 and a portion of this stream is withdrawn as partially oxidized white liquor product 11 (OWL(T)), which typically has a molar ratio of sodium sulfide to total sulfur of less than about 0.2. The remaining partially oxidized white liquor stream 13 is heated if required in exchanger 105 by indirect heat exchange with hot oxidized white liquor stream 31 and heated stream 15 flows into reaction zone 107. Partially oxidized white liquor is contacted therein with oxygen supplied by oxygen-rich stream 17 whereby the unoxidized and partially oxidized sulfur compounds are further oxidized to form sodium sulfate. The flow of stream 17 is controlled such that the molar ratio of oxygen therein to sodium sulfide in stream 1 is between about 1.0 and about 1.3, and the temperature in reaction zone 107 is maintained between about 300° F. to 380° F. by controlling the flow of hot oxidized white liquor stream 27 through exchanger 105; the required flow of stream 27 will depend upon the temperature, flow rate, and concentration of unoxidized sulfur compounds of stream 13, and other factors. Optionally, heat exchange may take place within reaction zone 107 after oxygen is in contact with the white liquor and the reaction has commenced. Optionally, other known means for adding heat to reaction zone 107 may be used. In certain cases, it is possible that the combination of high concentrations of unoxidized and partially oxidized sulfur compounds in stream 15 and the desired temperature in reaction zone 107 will require cooling rather than heating in exchanger 105. Alternately, it may be desirable to operate the reaction zone autothermally by neither heating nor cooling stream 13, in which case the temperature in the reaction zone will reach a level determined by the heat of reaction and the heat leak characteristics of the reaction system. At least 80% and preferably 90% of the unoxidized and partially oxidized sulfur compounds in stream 15 are converted to sodium sulfate. Unconsumed oxygen, inert gases, and steam may be vented from the reaction zone in stream 19. Oxidized white liquor stream 21 is withdrawn from reaction zone 107 and split into stream 25, which supplies heat to exchangers 101 and 105, and product stream 23, which is combined with cooled product streams 29 and 33 via stream 35 to provide fully oxidized white liquor product 37 (OWL(S)). Reaction zones 103 and 107 are operated at pressures between about 20 and 300 psig, preferably between about 40 and 180 psig. Reaction zones 103 and 107 can be contained in separate zones of a single reaction vessel or alternately each zone can be contained in a separate reaction vessel. Preferably, reaction zones 103 and 107 are operated in a completely mixed gas-liquid two-phase mode using known agitated reactor technology for contacting the respective white liquors and oxygen-containing gas streams. Oxygen-rich gas streams 5 and 17 contain at least 80 vol % oxygen and can be supplied for example by vaporizing hauled-in liquid oxygen, by an onsite cryogenic air separation system, or by an onsite adsorptive air separation system.

The two key features of this invention are (1) specific amounts of OWL(T) and OWL(S) can be produced to satisfy each individual mill requirement, and (2) the reactor volumes and oxygen requirements can be optimized to minimize reaction zone residence time and hence reactor cost, and to minimize operating costs such as oxygen dosage and mixing horsepowers, by control of the temperatures and oxygen addition rates to each reactor or reaction zone. In the first reaction zone 103, temperature is controlled between about 180° F. and 325° F. (depending in part on feed sulfide concentration) in order to maximize the amount of sulfide removed per unit of oxygen added and minimize the amount of oxygen utilized to convert thiosulfate and sulfite to sulfate. In the second reaction zone 107, the temperature is controlled between about 300° F. and 380° F. to minimize the volume of the reaction zone; the optimum temperature depends upon reactor pressure. These features are discussed further in the Examples which follow.

In an alternate mode of operation as earlier described, the system of FIG. 1 is operated without exchanger 101, reaction zone 103, and associated streams, such that white liquor feed stream 1 flows directly into exchanger 105 and flows as heated stream 15 into reaction zone 107. In this mode, all of white liquor feed stream 1 is converted into a fully oxidized white liquor product 37 (OWL(S)), and no partially oxidized white liquor (OWL(T)) is produced. Stream 17 is an oxygen-containing gas, either air or enriched air, or preferably is an oxygen-rich gas containing at least 80 vol % oxygen. In this mode, reaction zone 107 is a single reactor operating at between about 180° F. and about 380° F. (depending in part on sulfide concentrations in the feed), and at a pressure between about 20 and 300 psig, preferably between about 40 and 180 psig. Temperature in the reactor is controlled as earlier described by utilizing a portion 25 of reaction zone 107 effluent 21 to heat white liquor feed in exchanger 105. The required flow of stream 27 will depend upon the temperature, flow rate, and concentration of unoxidized sulfur compounds of white liquor stream 1, and other factors. Optionally, other known means for adding heat to reaction zone 107 may be used. In certain cases, it is possible that the combination of high oxidizable sulfur compound concentration in stream 1 and a lower desired temperature in reaction zone 107 will require cooling rather than heating in exchanger 105. Alternately, it may be desirable to operate the reaction zone autothermally by neither heating nor cooling stream 1, in which case the temperature in the reaction zone will reach a level determined by the heat of reaction and the heat leak characteristics of the reaction system. Preferably, reaction zone 107 is operated in a completely mixed gas-liquid two-phase mode using known agitated reactor technology for contacting the white liquor and oxygen-containing gas stream.

It is also possible as earlier described to operate the process of the present invention in an alternate mode in which the white liquor feed is split and passed through two parallel reaction zones to yield OWL(T) and OWL(S) products. In this mode, the oxygen addition rate and temperature are controlled independently in each reaction zone to yield the appropriate product and minimize the volume of each reaction zone.

The invention is also a fully oxidized white liquor product (OWL(S)) made by the either the primary or alternate modes of operation described above. This OWL(S) product comprises about 50 to 150 g/l sodium hydroxide, about 20–200 g/l sodium sulfate, and less than about 15 g/l of oxidizable sulfur compounds. This product preferably contains less than 10 g/l and most preferably contains less than 5 g/l of oxidizable sulfur compounds.

In its primary mode of operation, the present invention allows the optimum use of oxidized white liquor as a source of alkali for a number of process steps in a kraft mill. For one group of process applications, partially oxidized white Liquor (OWL(T)) is satisfactory as a replacement for fresh sodium hydroxide as long as the residual sulfide concentrations are below certain levels. These applications include oxygen delignification, gas scrubbing applications, removal of residual chlorine or chlorine dioxide from bleach plant effluents, regeneration of ion exchange columns, and neutralization of various acidic streams in the pulp mill. OWL(T) can also be used as an alkali in alkali extraction (E) and oxygen alkali extraction ($E_o$) stages in the absence of downstream oxidative bleaching stages. Since the presence of partially oxidized sulfur compounds such as sodium sulfite and sodium thiosulfate are not known to be detrimental in these applications, the white liquor can be oxidized only to the extent needed to remove sulfides, thus minimizing reactor size and oxygen consumption in the white liquor oxidation step as earlier discussed. The preferred maximum residual sulfide levels in OWL(T) for these applications depends on site-specific process characteristics and economics, and is typically less than 5 g/l and most preferably between 0.1 and 0.5 g/l. In a second group of applications, the presence of any significant level of unoxidized or partially oxidized sulfur compounds in the oxidized white liquor is detrimental and the use of OWL(S) is preferred. These applications include peroxide, ozone, hypochlorite, and chlorine dioxide bleaching, peroxide-enhanced alkali extraction ($E_p$), peroxide-enhanced oxidative extraction ($E_{op}$), and as an alkali source in the production of sodium hypochlorite. In these applications, residual oxidizable sulfur compounds in the OWL(S) should generally be below about 10–15 g/l. Generally, OWL(S) is the preferred form of alkali for use in alkaline pulp bleaching stages, including alkali extraction (E) and oxygen alkali extraction ($E_o$), because this use eliminates the negative effects of residual oxidizable sulfur compounds in any given bleaching stage or subsequent bleaching stage which uses the expensive oxidants described earlier. Oxidized white liquor should be filtered to remove particulates prior to use in any type of extraction stage. Also, OWL(S) may be preferred over OWL(T) for oxygen delignification of pulps from certain types of woods.

The invention is also a method of controlling the operation of the two stage white liquor oxidation reaction system described above. This is accomplished by: (a) selecting the individual flow rates of partially oxidized and fully oxidized white liquor products required in a given mill; (b) determining the maximum allowable sulfide concentration in the partially oxidized white liquor product and the maximum allowable concentration of oxidizable sulfur compounds in the fully oxidized white liquor product; (c) introducing a feed stream of unoxidized white liquor into the first reaction zone and contacting the stream with a first stream of oxygen-rich gas which is controlled at a first flow rate sufficient achieve the maximum allowable sulfide concentration while minimizing oxygen consumption, wherein the flow rate of the feed stream is equal to the total flow of the partially oxidized and fully oxidized white liquor products; (d) withdrawing a stream of partially oxidized white liquor from the first reaction zone and dividing the stream into the partially oxidized white liquor product and an intermediate feed stream; (e) introducing the intermediate feed stream into a second reaction zone and contacting the stream with a second stream of oxygen-rich gas which is controlled at a second flow rate sufficient achieve the maximum allowable concentration of oxidizable sulfur compounds while minimizing oxygen consumption; and (f) withdrawing a stream of fully oxidized white liquor product from the second reaction zone. The temperature in the first reaction zone is controlled at a level which minimizes the required liquid residence time to achieve the maximum allowable sulfide concentration at the first flow rate of oxygen. The temperature in the second reaction zone is controlled at a level which minimizes the required liquid residence time to achieve the maximum allowable concentration of oxidizable sulfur compounds at the second flow rate of oxygen. This temperature can be selected by utilizing a process model as described in Example 3 which follows.

The invention is also a method of controlling the operation of a single stage white liquor oxidation reaction system. This is accomplished by: (a) selecting the flow rate of oxidized white liquor required in a given mill; (b) determining the maximum allowable sulfide concentration and the maximum allowable concentration of oxidizable sulfur compounds in the oxidized white liquor; (c) introducing a feed stream of unoxidized white liquor into a reaction zone and contacting the stream with a stream of oxygen-containing gas which is controlled at a flow rate sufficient achieve the maximum allowable sulfide concentration and the maximum allowable concentration of oxidizable sulfur compounds while minimizing oxygen consumption; and (d) withdrawing a stream of oxidized white liquor from the reaction zone. The temperature in the reaction zone is controlled at a level which minimizes the required liquid residence time to achieve the maximum allowable sulfide concentration and maximum allowable concentration of oxidizable sulfur compounds at the specific flow rate of oxygen-containing gas.

EXAMPLE 1

Figure 2:
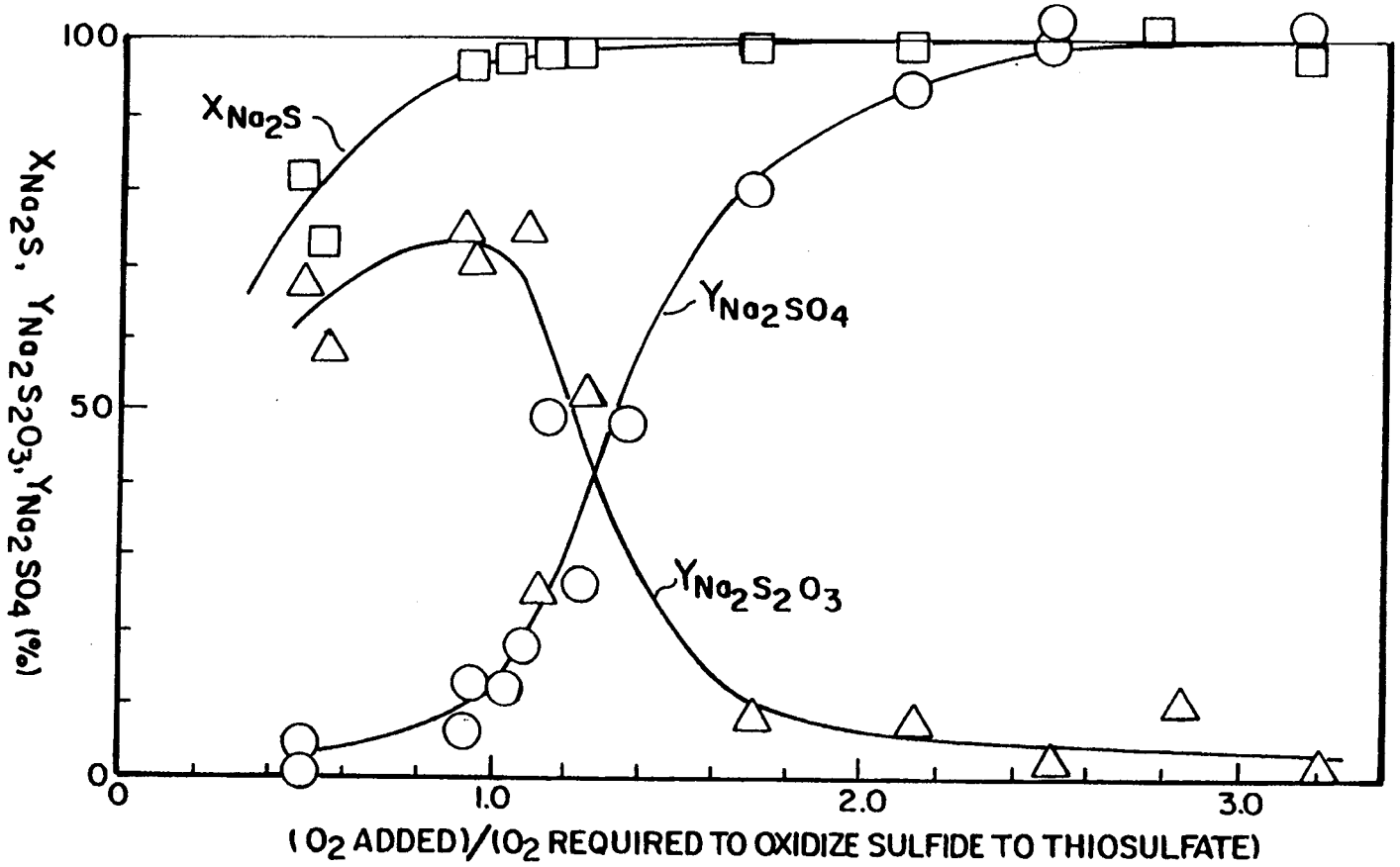
FIG. 2 is a plot describing the conversion of sulfur-containing species as a function of the amount of oxygen added for the process of the present invention.

White liquor oxidation with oxygen was studied experimentally in a kraft pulp mill using a 850 gallon pressurized stirred tank reactor using a 15 HP top-mounted agitator. White liquor containing 23–38 g/l sodium sulfide, 1–4 g/l sodium thiosulfate, 0–2 g/l sodium sulfite, and 3–7 g/l sodium sulfate was fed continuously to the reactor at 7–17 gpm while oxygen of 99.9 vol % purity was introduced into the reactor at different flow rates to investigate the effect of oxygen addition rate on the extent of sulfide and thiosulfate conversion. Liquid holdup time in the reactor was 40–118 minutes and the reactor was operated at temperatures between 263 and 329° F. and at total pressures between 18 and 98 psig. Brownstock washer filtrate containing 5 wt % total dissolved solids optionally was added as a catalyst in the range of 0–9 vol % on feed. Concentrations of sodium sulfide, thiosulfate, sulfite, and sulfate were measured at the inlet and outlet of the reactor for each set of operating conditions, and yield and conversion information were calculated as defined by:

$X_{Na2S}$ = % conversion of sodium sulfide to any oxidation product $Y_{Na2S203}$ = % sodium thiosulfate yield expressed as actual increase in thiosulfate concentration divided by the concentration of thiosulfate if all inlet sodium sulfide were oxidized to thiosulfate $Y_{Na2SO4}$ = % sodium sulfate yield expressed as actual increase in sulfate concentration divided by the concentration of sulfate if all inlet sodium sulfide were oxidized to sulfate The results of these tests are plotted in FIG. 2 as a function of the relative oxygen addition ratio, which is defined as the amount of oxygen added to the reactor divided by the amount of oxygen required to oxidize all sulfide in the reactor feed to thiosulfate. These results indicate that about 98% of the sulfide is removed at an oxygen addition ratio of about 1.0 by conversion to thiosulfate and a small amount of sulfate. Essentially all sulfide is removed at an oxygen addition ratio of about 1.3 by conversion to thiosulfate and sulfate. At an overall oxygen addition ratio of greater than about 2.2, essentially all sulfur compounds are converted to sulfate and the white liquor is completely oxidized. The catalyst was found to have no major effect on the rate or selectivity of the reactions under these conditions.

These results illustrate that the present invention allows the controlled oxidation of white liquor to yield any degree of oxidation required for specific kraft mill applications. In the primary mode of operation of the invention as earlier described the oxidation is carried out in two reaction zones or reactors in series; the first stage is operated preferably at an oxygen addition ratio of between about 1.0 and 1.3 to remove sulfide and the second stage is operated to achieve an overall oxygen addition ratio for both stages of between about 2.0 and 2.6 in order to remove remaining oxidizable sulfur compounds. This mode of operation provides two oxidized white liquor products for the applications discussed above. In an alternate mode of operation, the white liquor can be reacted with oxygen in a single stage to a desired degree of oxidation by choosing the appropriate oxygen addition ratio based on FIG. 2.

EXAMPLE 2

Figure 3:
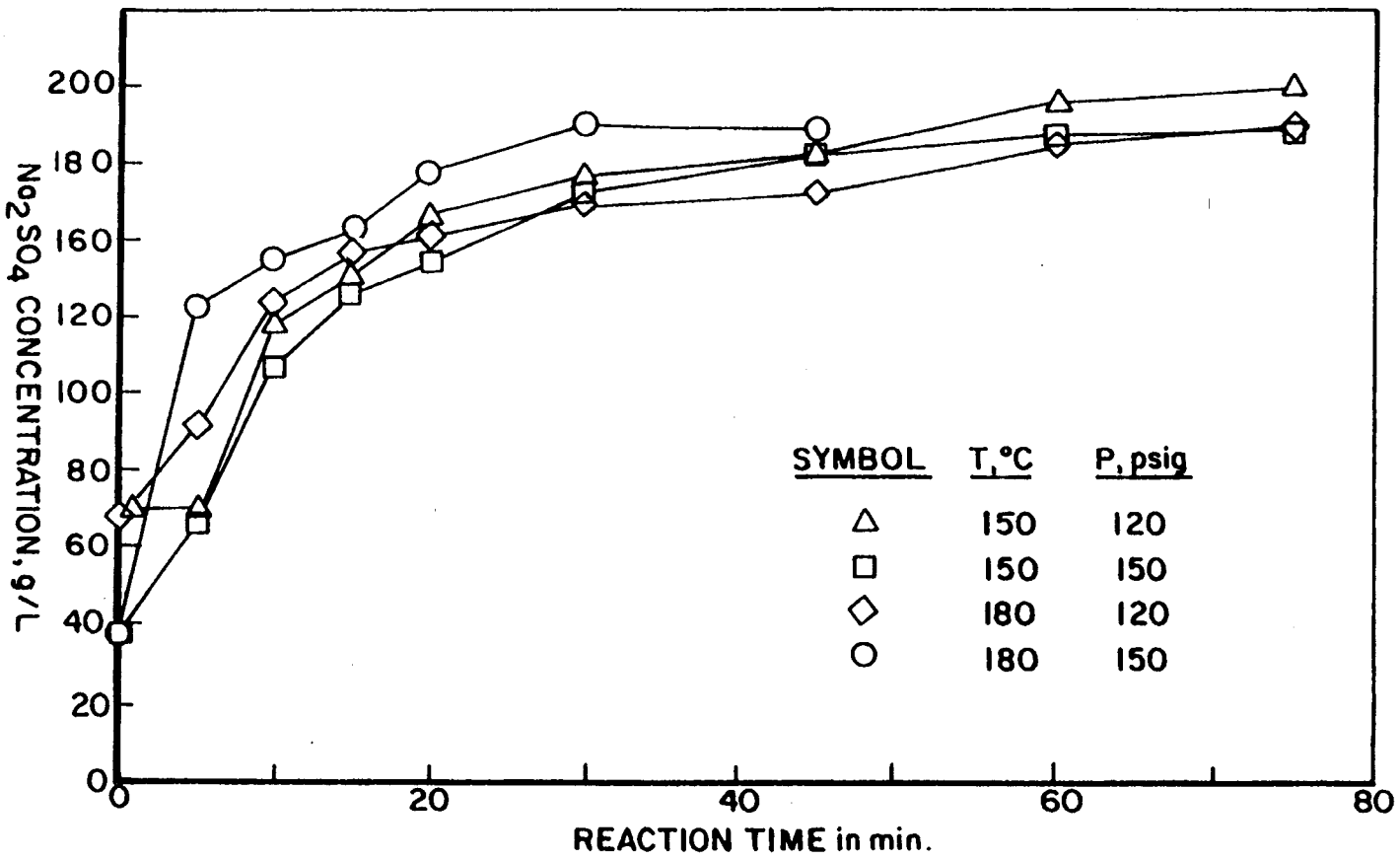
FIG. 3 is a plot describing the sodium sulfate concentration vs time for a batch oxidation of sodium thiosulfate to sodium sulfate.

A series of experiments was carried out to understand in more depth the oxidation of thiosulfate in white liquor. A sample of fully oxidized white liquor from Example 1 was modified by the addition of 40 g/l sodium thiosulfate to give an initial thiosulfate concentration of 50–55 g/l. The liquor contained about 100 g/l sodium hydroxide, 6 g/l sodium sulfite, and 36 g/l of sodium sulfate. For each experiment, a sample of the liquor was charged to a heated 4 liter stainless steel reactor fitted with a hollow shaft turbine mixer which circulated liquid and gas from top to bottom in the reactor. Initially the reactor was pressurized with nitrogen to 150 psig and mixed while being heated to about 160° C. When heating was complete, the reactor was purged with oxygen for about one minute and set on pressure control wherein oxygen was added to maintain reactor pressure as oxygen was consumed in the reaction. Temperature was controlled at the desired temperature by electric heaters and cooling coils. At time zero, the mixer was set to 1800 RPM, oxygen flow was started, and initial liquid samples were taken. As the reaction proceeded, regular liquid samples were taken along with measurements of oxygen addition rate and temperature. Liquid samples were analyzed for thiosulfate, sulfate, and (in some samples) sulfite. Several runs were made at 150° and 180° C. for pressures of 120 and 150 psig. The results of these runs are plotted as sulfate concentration vs reaction time in FIG. 3, which demonstrates that complete oxidation at these operating conditions can be achieved in 30–60 minutes reaction time.

EXAMPLE 3

The two-stage oxidation of white liquor to partially oxidized white liquor, or OWL(T), and fully oxidized white liquor, or OWL(S), was modelled using data from the literature and from Examples 1 and 2. The purpose of the modelling was to understand the relationship among operating parameters in the oxidation process, particularly the effects of pressure, temperature, oxygen addition rates, and reactor residence time. Reaction rate constants for the oxidation of sulfide to thiosulfate were taken from the article entitled "Kinetics of Oxidation of Aqueous Sodium Sulfide by Gaseous oxygen in a Stirred Cell Reactor" by E. Alper and S. Ozturk in *Chem. Eng. Comm.* 36, pp. 343–349, 1985. Reaction rate constants for the oxidation of thiosulfate to sulfate were determined from the data of Example 2. Expressions given by F. V. Danckwerts at pp. 226–228 in his book entitled *Gas-Liquid Reactions* (McGraw-Hill, New York, 1970) were used to model the dependencies of the mass transfer coefficients and interfacial area on physical properties and process parameters. The coefficients were determined using data from Example 1.

The model was used to calculate system operating parameters based upon the following criteria and conditions: (1) 98% of the sulfide is oxidized in the first stage reactor; (2) 95% of the total sulfur in the fully oxidized white liquor product is in the form of sulfate; (3) the molar flow of oxygen to each reactor stage is 1.1 or 1.5 times the molar flow of sodium sulfide in the feed; (4) the reactors are stirred tank reactors; and (5) feed sodium sulfide concentration of 25 g/l. The system pressure was selected as 100, 150, and 200 psig and the temperature in each reactor was varied to observe the reactor residence time required for the selected sulfide and thiosulfate conversion.

Figure 4:
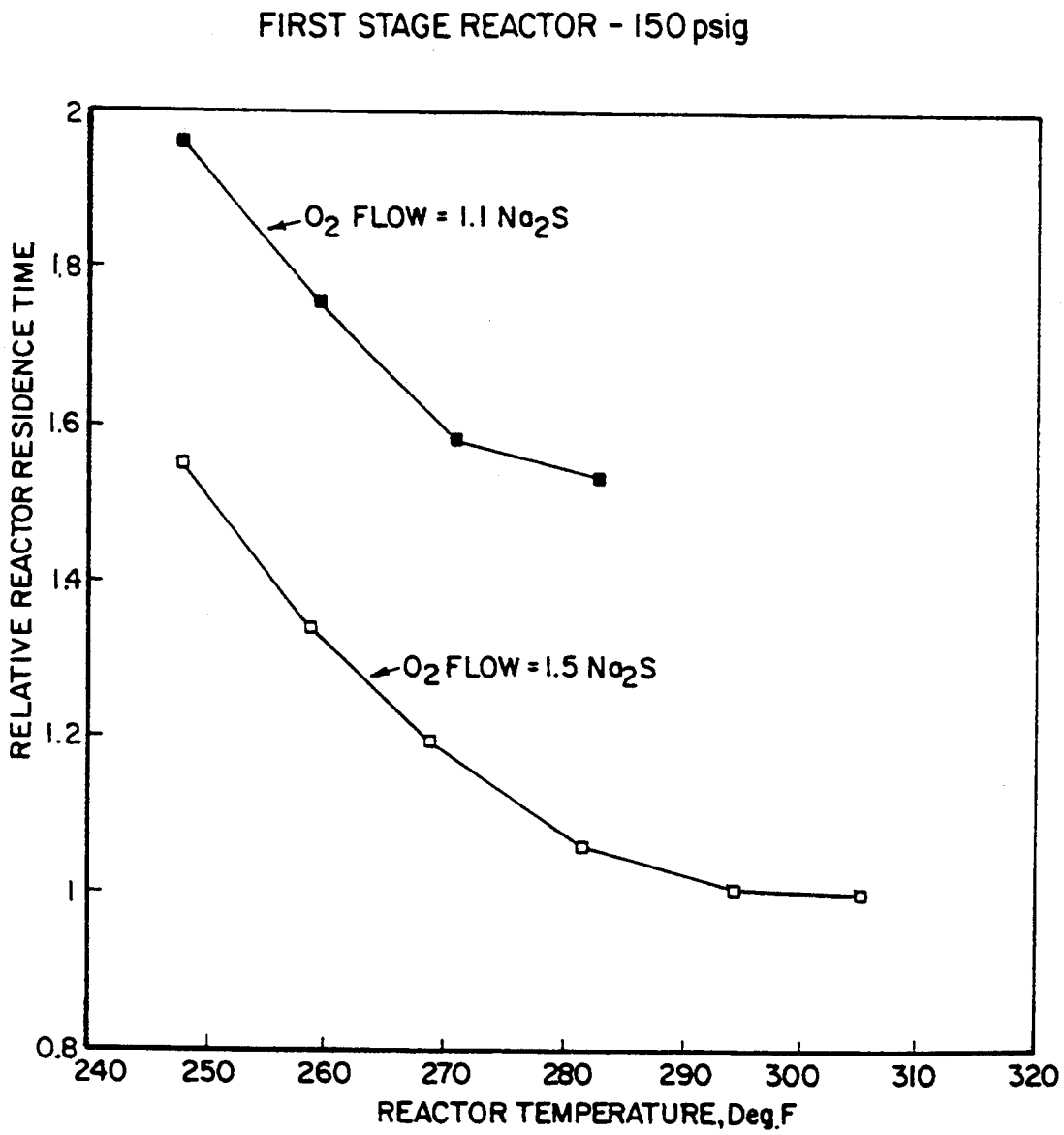
FIG. 4 is a plot of relative reactor residence time vs reactor temperature for the oxidation of sulfide at 150 psig by the method of the present invention.

The required reactor residence times were calculated at different temperatures for an operating pressure of 150 psig and the two oxygen to sulfide flow ratios of 1.1 and 1.5. Results for the first stage reactor are plotted as relative reactor residence time vs temperature in FIG. 4. The two curves end at the temperatures at which the added oxygen is completely consumed; this occurs because oxygen in excess of that needed to oxidize the required fraction of sulfide to thiosulfate is consumed by further oxidation of thiosulfate to sulfate. The curves also indicate that increasing temperature reduces reactor residence time, and that the benefits of further increases in temperature above about 280°–300° F. are negligible. It may be possible in certain mills that a hot white liquor feed (for example 200° F.) with a high sulfide content (for example 50 g/l) will result in an autothermal temperature of up to 325° F. in the reactor effluent. This is the practical upper temperature limit at which the first stage reactor should be operated, and is the basis for the upper temperature limitation in the first stage reactor as defined earlier in this specification. The benefit of increasing the temperature diminishes at the higher temperatures, possibly because (1) at constant total pressure after a certain temperature is reached the ratio of the kinetic constant to oxygen partial pressure declines and (2) at constant oxygen partial pressure the solubility of oxygen decreases with increasing temperature. Increasing the oxygen addition rate reduces the required reactor residence time and thus capital cost, but increases operating cost because of lower oxygen utilization. The choice of oxygen addition rate is therefore a balance between capital and operating costs which is determined by the operating management of each individual mill.

Figure 5:
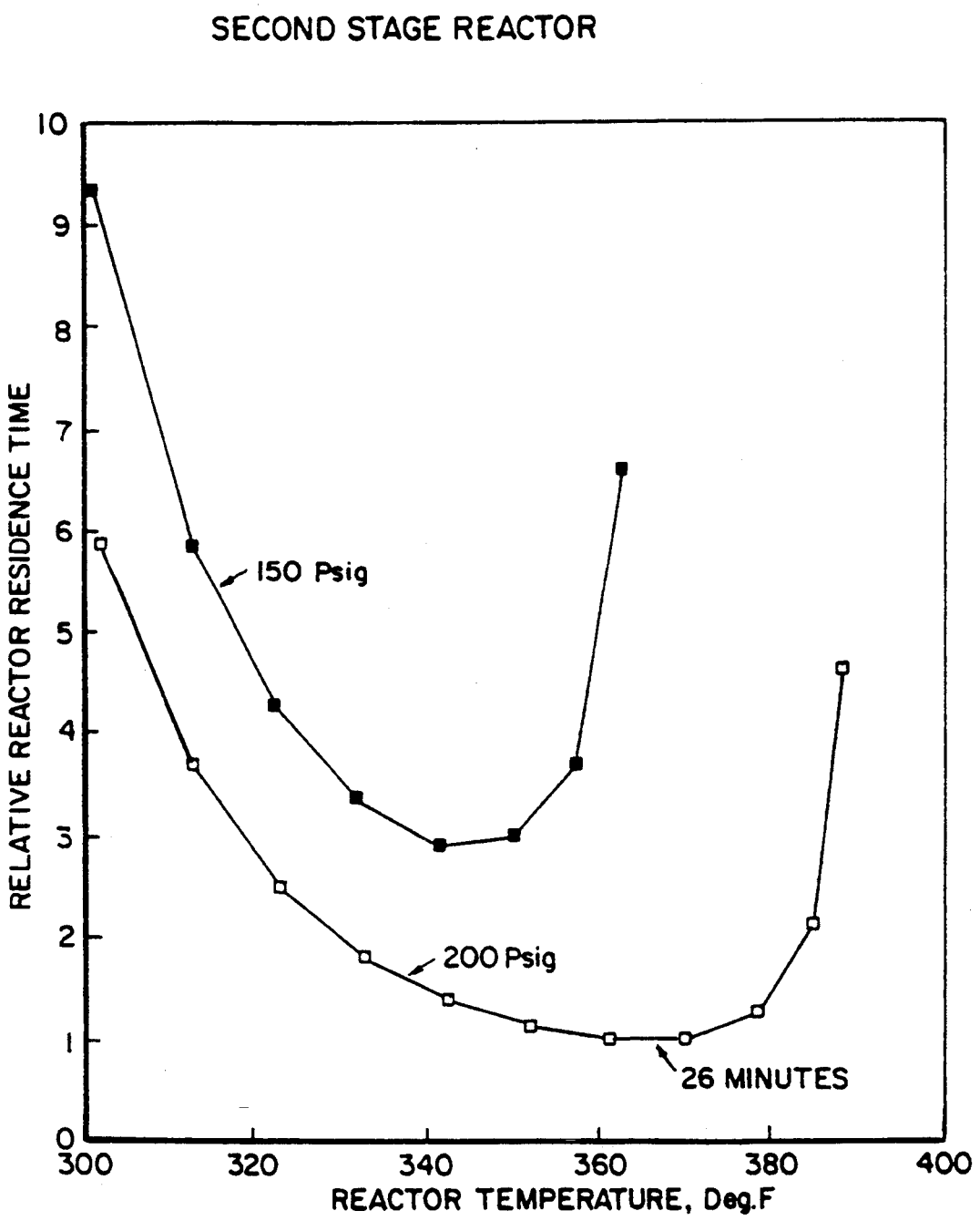
FIG. 5 is a plot of relative reactor residence time vs reactor temperature for the oxidation of thiosulfate at 150 and 200 psig by the method of the present invention.
Figure 6:
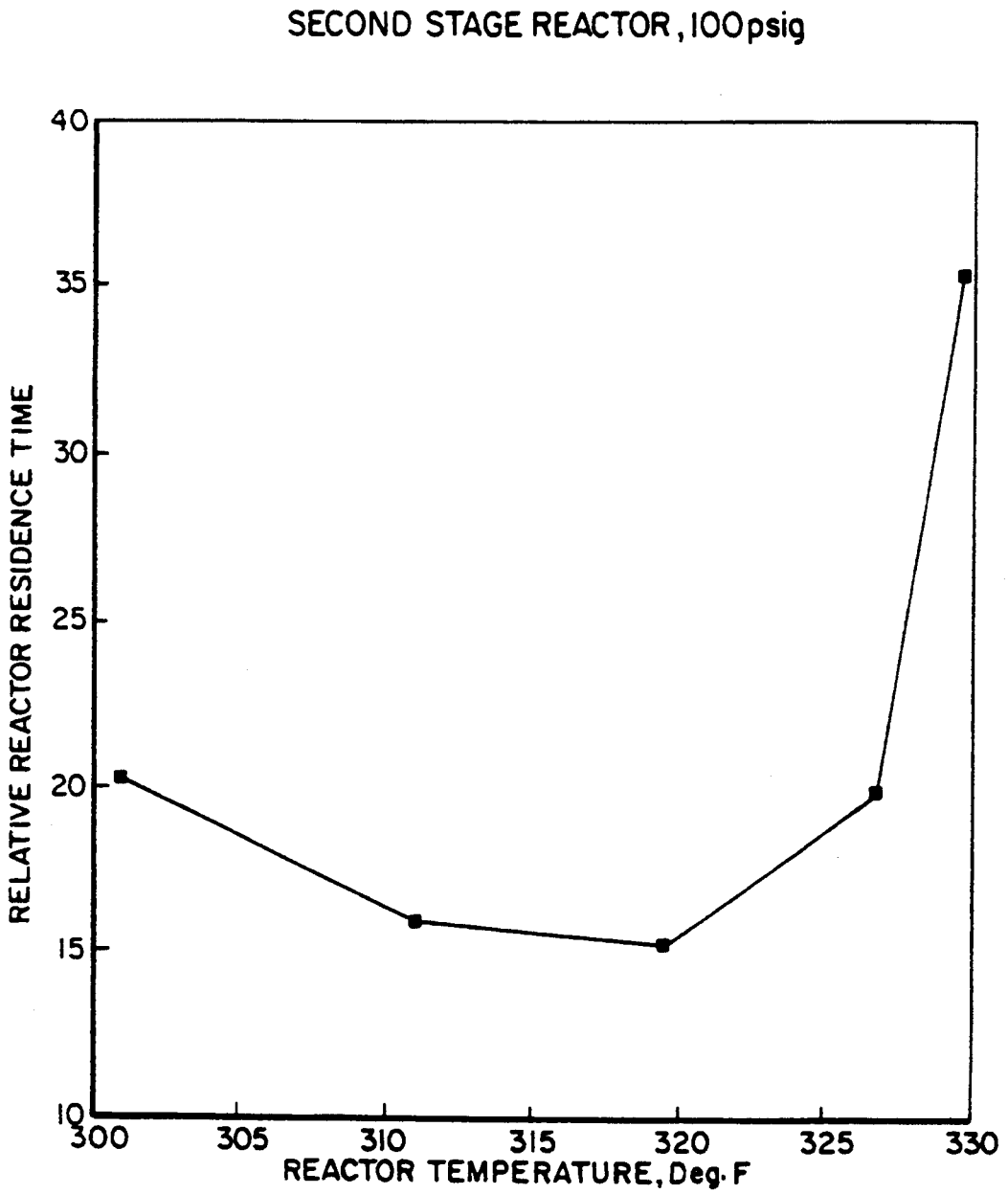
FIG. 6 is a plot of relative reactor residence time vs reactor temperature for the oxidation of thiosulfate at 100 psig by the method of the present invention.

The effect of temperature on reactor residence time was calculated for the second stage reactor using a molar flow of oxygen to the reactor of 1.1 times the molar flow of sodium sulfide in the first stage feed, and at pressures of 100, 150, and 200 psig. The results of relative reactor residence time vs temperature for the two higher pressures are shown in FIG. 5 and clearly indicate sharp and unexpected minima in the residence time vs temperature curves for the two pressures. The minimum residence time at 200 psig is 26 minutes and occurs at about 365° F. At 150 psig, the minimum residence time is three times higher and occurs at about 345° F. Results for a pressure of 100 psig are plotted in FIG. 6 and indicate a less sharp minimum and a much higher minimum reactor residence time compared with the higher pressures of FIG. 5. These results indicate that the two-stage white liquor oxidation system should be operated at pressures between about 100 and 300 psig, preferably between about 100 and 200 psig. The selection of operating pressure is an economic tradeoff between reactor volume and pressure rating, as well as the judgement of mill operators regarding other equipment limitations at higher pressures. These results suggest that the second stage reactor should be operated at a temperature between about 300 and 380° F., with a specific narrower range selected depending on the actual operating pressure.

This Example supports a key feature of this invention in which the each of the first and second stage reactors is operated in different specific temperature ranges. The first stage is operated at lower temperatures which favor the efficient removal of sulfide to form thiosulfate while minimizing consumption of oxygen to oxidize thiosulfate or sulfite to sulfate. The second stage is operated at higher temperatures required for conversion of the partially oxidized sulfur compounds to sulfate at reasonable reactor residence times.

EXAMPLE 4

Sodium hydroxide, white liquor (WL), partially oxidized white liquor (OWL(T)), and fully oxidized white liquor (OWL(S)) were evaluated in the laboratory as alkali sources for oxygen delignification and further bleaching steps using peroxide and hypochlorite. Two sets of experiments were performed using a softwood kraft pulp with an initial Kappa number of 34.5: (1) medium consisting oxygen delignification (OD), and (2) OD followed by a bleaching step.

Figure 7:
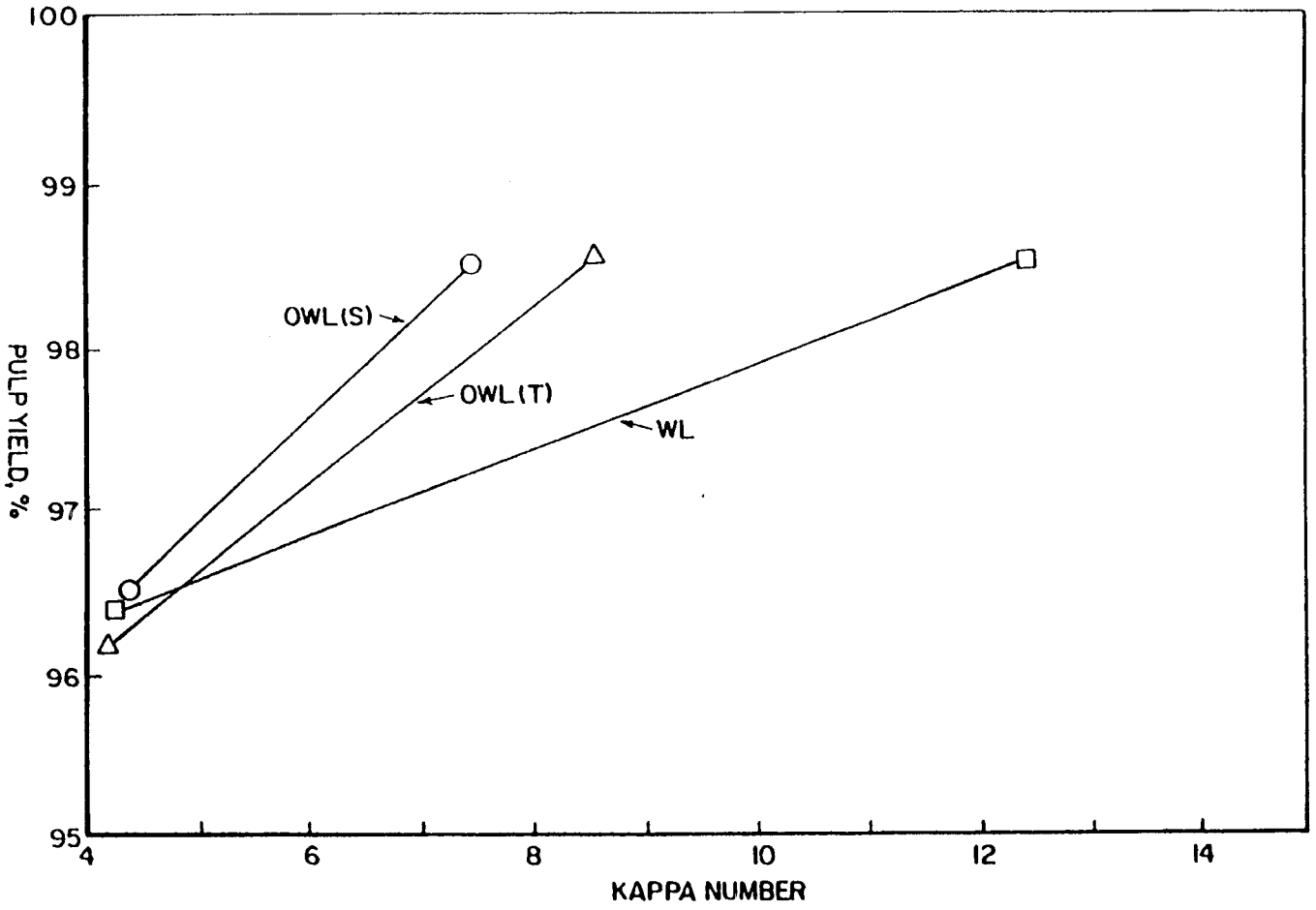
FIG. 7 is a plot of pulp yield vs Kappa number for medium consistency oxygen delignification using unoxidized white liquor and oxidized white liquor produced by the method of the present invention as alkali sources.
Figure 8:
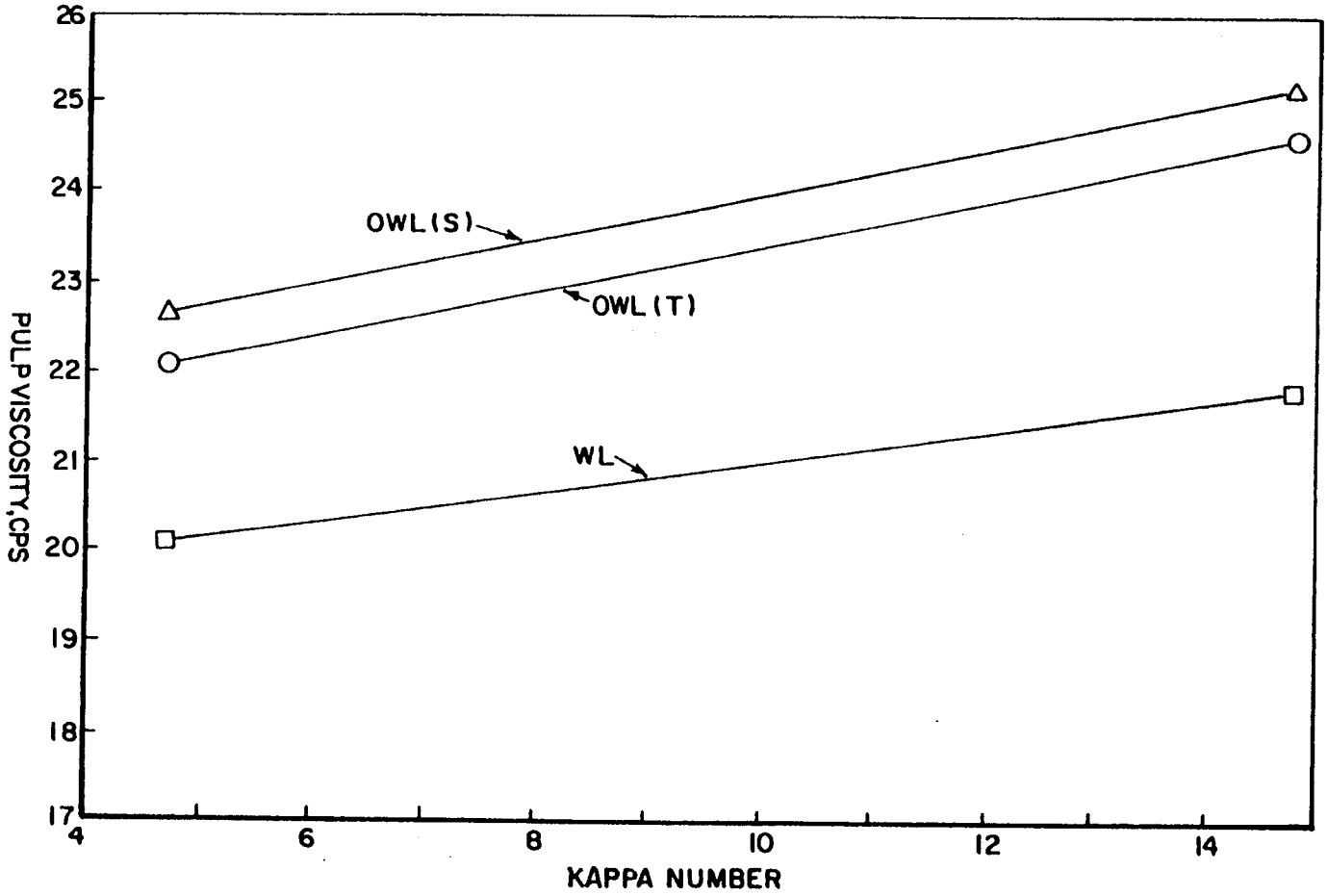
FIG. 8 is a plot of pulp viscosity vs Kappa number for medium consistency oxygen pulping using unoxidized white liquor and oxidized white liquor produced by the method of the present invention as alkali sources.

In the first set of experiments, the kraft pulp was oxygen delignified at the following conditions: 10% consistency, 203° F., 90 psig total pressure, reaction time of 60 minutes, and alkali doses of 1 and 3 wt % expressed as NaOH on oven dried pulp. Pulp viscosity (a measure of pulp strength), pulp yield, and Kappa number were determined on each treated pulp sample. GE brightness was measured for handsheets made from the treated pulp. The results presented in FIG. 7 indicate that the use of OWL(T) and OWL(S) gives better lignin removal and higher pulp yield than WL, with OWL(S) giving slightly better results than OWL(T). The results presented in FIG. 8 indicate that the use of OWL(T) and OWL(S) gives higher pulp viscosity than WL, with OWL(S) giving slightly better results than OWL(T). GE brightness results (interpolated for a Kappa number of 12) are presented in Table 1 for handsheets made from treated pulp, and indicate that OWL(S) gives a brightness equivalent to that of NaOH and slightly better than those of WL and OWL(T).

TABLE 1

OD Brightness vs Alkali Source

| Alkali Source | GE Brightness, % |
|---|---|
| NaOH | 33.4 |
| OWL (T) | 32.1 |
| OWL (S) | 33.5 |

TABLE 1-continued

OD Brightness vs Alkali Source

| Alkali Source | GE Brightness, % |
|---|---|
| WL | 32.1 |

In the second set of experiments with a softwood sulfane pulp, OD treatment was followed by hypochlorite bleaching. The objective was to study the possible effect of entrained solids and white liquor oxidation products after oxygen stage washing on downstream brightening stages. WL, OWL(T), and OWL(S) were used as alkali sources in the OD stage. All pulps were treated in OD under identical conditions followed by simulated washing, were diluted to 2% consistency, and were thickened to 10% consistency without fresh water addition. Hypochlorite bleaching was carried out at 3 wt % and 6 wt % dosage on pulp using NaOH as alkali, and handsheets were made and tested for GE brightness for all treated samples. The results of these experiments are summarized Table 2.

TABLE 2

Brightness vs OD Alkali Source for Hypochlorite Bleaching

| OD Alkali Source | Final Brightness, % (3 wt % Hypo) | Final Brightness, % (6 wt % Hypo) |
|---|---|---|
| NaOH | 65.6 | 71.1 |
| WL | 66.1 | 74.7 |
| OWL (T) | 69.1 | 73.9 |
| OWL (S) | 66.7 | 77.0 |

At the higher hypochlorite dose, OWL(S) produced the highest brightness. At the lower dose, OWL(T) produced the brightest pulp.

NaOH, OWL(T), and OWL(S) were evaluated as alkali sources for $E_{op}$ and P bleaching of a softwood sulfate pulp chlorinated to Kappa 23; the extracted pulp had a Kappa of about 14. Pulp viscosity and handsheet brightness were determined as summarized in Table 3, which clearly indicates that OWL(S) is the preferred alkali source.

TABLE 3

Viscosity and Brightness vs Alkali Source for Oxygen Extraction with Peroxide ($E_{op}$)

| Alkali Source | Viscosity Mpa-Sec | Brightness, % |
|---|---|---|
| NaOH | 20.5 | 26.2 |
| OWL (T) | 24.7 | 22.9 |
| OWL (S) | 25.0 | 25.8 |

The same softwood pulp was prebleached in a C $E_{op}$ H sequence to a brightness of 59.7% and treated with peroxide at 1.2 wt % hydrogen peroxide, 158° F., 10% consistency, 2 hours residence time, 1.8 wt % NaOH, and 0.05 wt % magnesium sulfate. The results in Table 4 show that OWL(S) is clearly the preferred alkali source.

TABLE 4

Viscosity and Brightness vs Alkali Source for Peroxide Bleaching

| Alkali Source | Viscosity Mpa-Sec | Brightness, % |
|---|---|---|
| NaOH | 6.1 | 78.2 |
| OWL (T) | 6.5 | 75.5 |

TABLE 4-continued

| Viscosity and Brightness vs Alkali Source for Peroxide Bleaching | | |
|---|---|---|
| Alkali Source | Viscosity Mpa-Sec | Brightness, % |
| OWL (S) | 6.6 | 78.4 |

EXAMPLE 5

Figure 9:
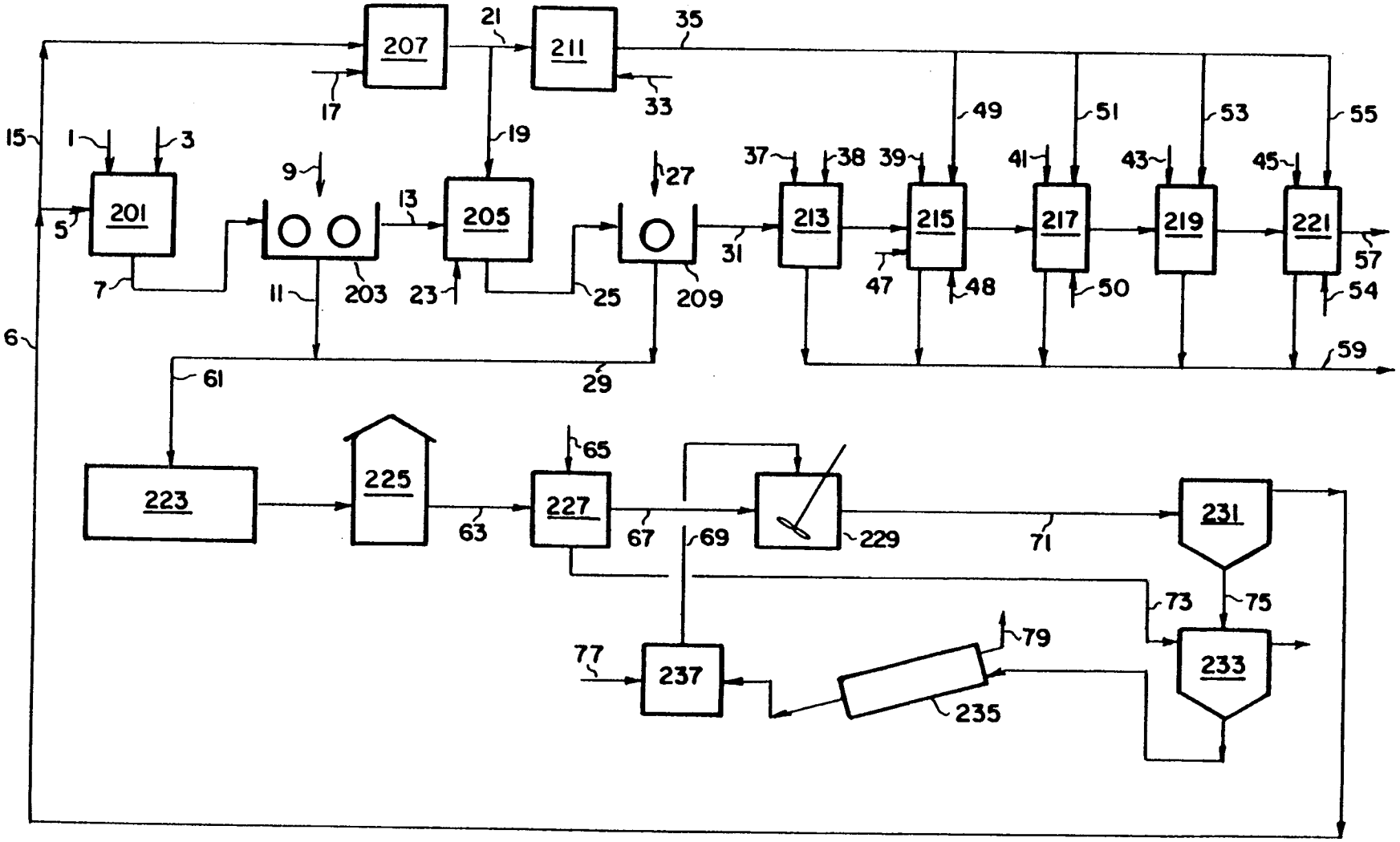
FIG. 9 is a schematic flow sheet of a typical open kraft pulp mill which illustrates uses within the mill for oxidized white liquor produced by the method of the present invention.

A mass balance for a 1000 TPD (oven-dried short tons per day) southern pine integrated kraft mill was calculated to illustrate the utilization of OWL(T) and OWL(S) in the mill, a schematic flowsheet of which is given in FIG. 9. Wood chips 1, sodium hydroxide 3 (optional), and a portion 5 of recycled white liquor stream 6 are fed to digester 201 and cooked to pulp and partially delignify the wood. The pulp and spent pulping liquor as stream 7 flows to decker 203 with wash water stream 9 in which the pulp is washed and separated from the strong black liquor 11. Wash water stream 9 can be fresh water or recycled filtrate from a downstream washer. The remainder 15 of recycled white liquor stream 6 at 175° F. is contacted with oxygen stream 17 (99.5 vol % purity) in first stage white liquor oxidation reactor 207 at 150 psig and 250° F. to yield OWL(T) streams 19 and 21. Unbleached pulp 13, at a consistency of 10–12%, passes to medium consistency oxygen delignification (OD) reactor 205 and is contacted therein with OWL(T) stream 19 and oxygen stream 23 (99.5 vol % purity) which further delignifies the pulp. Mixed pulp and spent liquor flow as stream 25 to washer 209 with wash water stream 27 (which can be fresh water or recycled filtrate from a downstream washer); OD stage filtrate stream 29 and further delignified pulp 31 are withdrawn therefrom. OWL(T) stream 21 is contacted with oxygen stream 17 (99.5 vol % purity) in second stage white liquor oxidation reactor 211 at 150 psig and 338° F. to yield OWL(S) stream 35.

Oxygen-bleached pulp 31 next passes sequentially through a five-stage bleach sequence consisting of chlorine bleaching with chlorine dioxide substitution ($C_D$) stage 213, peroxide-enhanced oxidative extraction ($E_{op}$) stage 215, chlorine dioxide (D) stage 217, alkali extraction (E) stage 219, and chlorine dioxide (D) stage 221. The overall bleaching sequence (including OD) is therefore O $C_D$ $E_{op}$ D E D. Each of these stages includes a wash step (not shown) which utilizes wash water stream 37, 39, 41, 43, and 45 respectively; the final four bleach stages each utilize OWL(S) as an alkali source via OWL(S) stream 49, 51, 53, and 55 respectively. Chlorine and chlorine dioxide are added to stage 213 as stream 38; oxygen and peroxide are added to stage 215 as streams 47 and 48 respectively; chlorine dioxide is added to stages 217 and 221 as streams 50 and 54 respectively. Final bleached pulp product is withdrawn as stream 57, and wash water streams (minus recycle, not shown) from the stages are combined into waste liquor stream 59.

Combined weak black liquor and oxygen delignification stage filtrate stream 61 passes into evaporator system 223 which concentrates the liquor prior to recovery boiler 225 in which the lignin and other organic wood-derived compounds are combusted to produce steam and to yield furnace smelt 63. This smelt is quenched and dissolved in dissolver 227 with added water 65 to produce green liquor stream 67, which is causticized with calcium hydroxide stream 69 in causticizer 229 to yield crude white liquor stream 71. The crude white liquor is clarified in white liquor clarifier 231 and final white liquor product stream 6 is recycled to the pulping process. Precipitated calcium carbonate in streams 73 and 75 is thickened in mud washer 233, calcined in lime kiln 235, and slaked along with makeup lime 77 in slaker 237 to yield calcium hydroxide stream 69. Optionally, a portion of OWL(T) stream 19 can be used to scrub lime kiln exhaust 79 (scrubbing not shown).

The composition of the unoxidized white liquor (WL) and oxidized white liquors are summarized in Table 5. It was assumed that 99% of the sulfide and sulfite in the WL are oxidized in the first stage reactor and that 99% of the thiosulfate is oxidized to sulfate in the second stage reactor.

TABLE 5

| White Liquor Compositions | | | |
|---|---|---|---|
| | Concentration, grams/liter | | |
| Component | WL | OWL (T) | OWL (S) |
| $Na_2S$ | 30 | 0.3 | 0.3 |
| NaOH | 100 | 100 | 83.5 |
| $Na_2S_2O_3$ | 3 | 33 | 0.33 |
| $Na_2SO_3$ | 1 | 0.01 | 0.01 |
| $Na_2SO_4$ | 4 | 5.1 | 64 |

The required amounts of white liquor stream 15, OWL(T) stream 19, and OWL(S) stream 35 were determined using typical dosages for the O, $E_{op}$, D, E, and D stages and are summarized in Table 6.

TABLE 6

| Open Mill Oxidized White Liquor Requirements | | | |
|---|---|---|---|
| Process Step | Equivalent NaOH Dose, wt % on Pulp | Type of WL | Flow, gpm |
| OD | 2.5 | OWL (T) | 41.6 |
| $E_{op}$ | 1.5 | OWL (S) | 29.9 |
| D | 0.6 | OWL (S) | 12.0 |
| E | 1.25 | OWL (S) | 24.9 |
| D | 0.6 | OWL (S) | 12.0 |
| | | Total | 120.4 |

The flow rates of oxygen streams 17 and 33 were calculated from the required degrees of oxidation and flow rates summarized in Tables 5 and 6, and a 20% excess of oxygen was used. The required amount of oxygen for the first stage reactor is 10,700 SCFH and for the second stage is 7,760 SCFH for a total of 18,470 SCFH.

EXAMPLE 6

Figure 10:
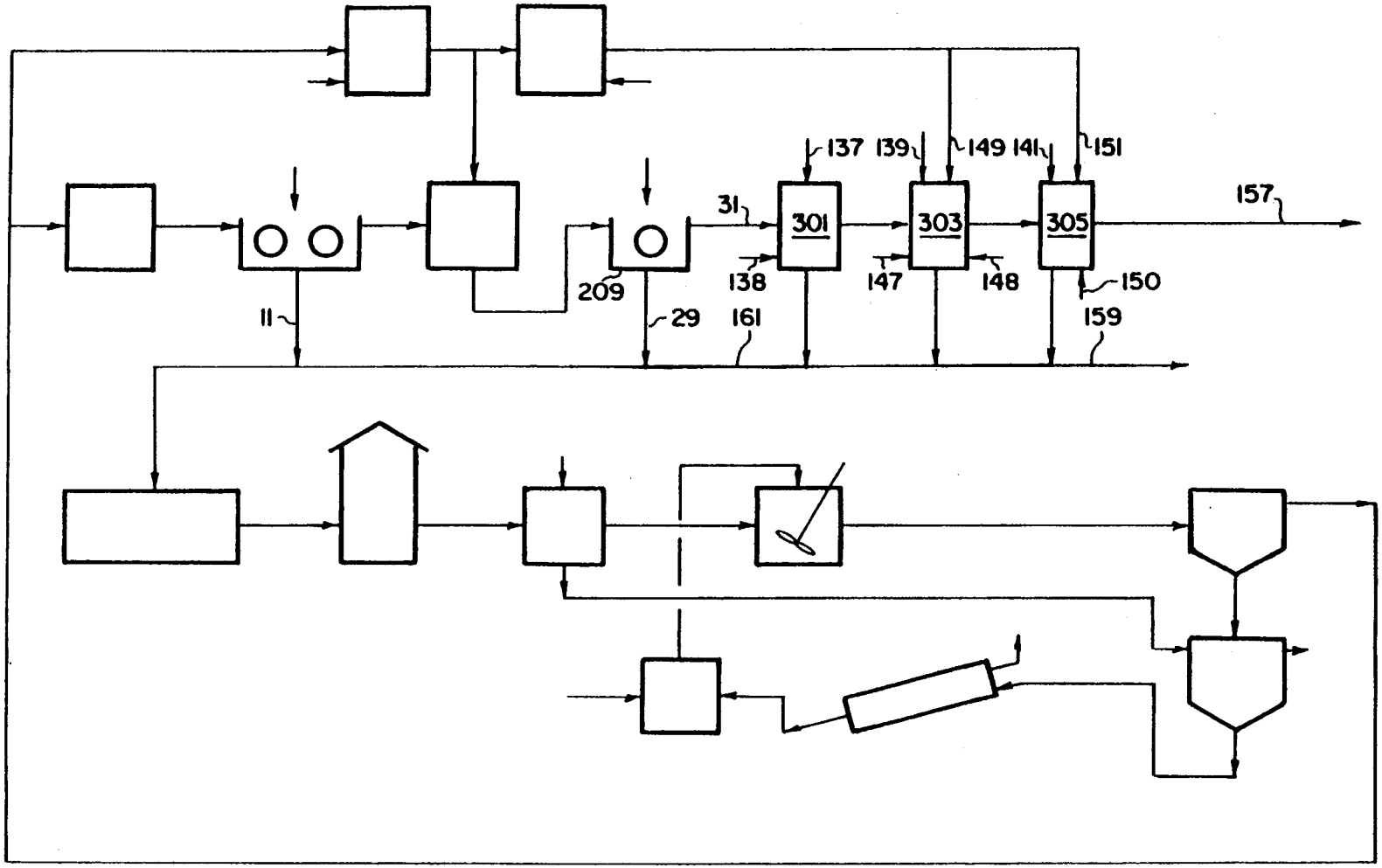
FIG. 10 is a schematic flow sheet of a closed kraft pulp mill employing non-chlorine bleaching sequences which illustrates uses within the mill for oxidized white liquor produced by the method of the present invention.

A mass balance was prepared for a modification of the integrated mill of Example 5 in which all chlorine-based bleaching stages are eliminated and the spent liquor from the remaining non-chlorine bleaching stages is sent along with the black liquor to the evaporation step and recovery boiler. This modification is termed a closed mill as compared with the open mill of Example 5, and represents the type of mill which will be utilized by many pulp and paper producers in coming years for its inherent environmental benefits. A coming years for its inherent environmental benefits. A schematic flowsheet of the closed mill is shown in FIG. 10. The mill operates essentially the same as the open mill of FIG. 9 except that (1) the bleaching sequence $C_D$ $E_{op}$ D E D is replaced by Z $E_{op}$ P where Z is ozone and P is peroxide, and (2) the spent liquors from these bleaching steps (minus any recycled filtrate) are recycled to the recovery system along with the black liquor. Referring to FIG. 10, partially bleached pulp 31 from washer 209 flows with ozone stream 138 and wash water 137 to ozone stage 301 in which the pulp is bleached and washed. The pulp flows next to oxygen-peroxide extraction stage 303, where oxygen 147, peroxide 148, wash water 139 (or recycled washer filtrate), and OWL(S) 149 are added and the pulp is further bleached. Finally, the pulp flows to peroxide stage 305 with wash water (or recycled washer filtrate) 141, peroxide 150, and OWL(S) 151 for final bleaching to produce pulp product 157. Stages 301, 303, and 305 include interstage washers not specifically shown. Spent liquor streams from these three stages (minus recycled filtrate) are combined as stream 161 which is then combined with black liquor streams 11 and 29 prior to the chemical recovery steps described in the previous example. A small purge stream 159 may be required to maintain the proper chemical balance in the mill, or alternately purge can be removed from individual bleaching stages.

White liquor was oxidized in the same manner as described in the previous example, but different amounts of OWL(S) were required for the final bleach stages. A mass balance was calculated for the closed mill of FIG. 10 and the white liquor requirements are summarized in Table 7. Oxygen requirements were 8,000 SCFH and 4,900 SCFH for the first and second stages respectively.

TABLE 7

| Closed Mill Oxidized White Liquor Requirements | | | |
|---|---|---|---|
| Process Step | Equivalent NaOH Dose, wt % on Pulp | Type of WL | Flow, gpm |
| OD | 2.5 | OWL (T) | 41.6 |
| Z | — | — | — |
| $E_{op}$ | 1.5 | OWL (S) | 29.9 |
| P | 1.0 | OWL (S) | 19.9 |
| | | Total | 91.4 |

The closed mill bleach sequence thus requires 24% less oxidized white liquor than the open mill bleach sequence of Example 5.

Thus the object of the present invention is the selective oxidation of white liquor with oxygen to yield partially and fully oxidized white liquor products for use as substitutes for sodium hydroxide in a number of kraft mill process steps. The use of both OWL(T) and OWL(S) as sources of alkali in a kraft mill can improve operations by reducing requirements for fresh alkali and allowing closer sodium and sulfur balances in the mill. OWL(T) can be used as an alkali in oxygen delignification, in which additional lignin is removed from kraft pulp to produce a higher brightness pulp. The use of OWL(T) in this process helps to maintain the balance of sodium and sulfur in the pulp mill, and this benefit is expected to become more important in the future as mills eliminate chlorine-based bleaching sequences and replace them with peroxide, ozone, and other nonchlorine sequences. OWL(T) also can be used for gas scrubbing applications, for removal of residual chlorine or chlorine dioxide from bleach plant effluents, for the regeneration of ion exchange columns, and for the neutralization of various acidic streams in the pulp mill.

OWL(S) can be used as an alkali source in process steps which utilize relatively costly oxidative bleaching chemicals to remove residual lignin and color from pulp to be used in high quality paper products. These process steps include peroxide, ozone, hypochlorite, and chlorine dioxide bleaching stages, as well as peroxide-enhanced alkali extraction ($E_p$) and peroxide- enhanced oxidative extraction ($E_{op}$). OWL(S) also can be used as an alkali source in the production of sodium hypochlorite.

A key feature of the invention is that both oxidized white liquor products are made in a two-stage reaction system in which each stage is operated at the optimum temperature to minimize reactor volume while achieving maximum oxygen utilization in making the two products. The required degree of oxidation for each product can be readily controlled by controlling the rate of oxygen addition to the reactors. It is also possible to produce a single product of fully oxidized white liquor which previously was not possible using prior art methods. An advantage of the invention is that at Least a portion of the heat required for reactor temperature control is provided by the exothermic heat of reaction, which is used to preheat the feed to each reactor by indirect heat exchange with reactor effluent.

The essential characteristics of the present invention are described completely in the foregoing disclosure. One skilled in the art can understand the invention and make various modifications thereto without departing from the basic spirit thereof, and without departing from the scope and range of equivalents of the claims which follow.

We claim:

1. A method for the selective oxidation of white liquor in a pulp mill using the kraft wood pulping process, said method comprising:

(a) contacting an unoxidized white liquor feed stream comprising sodium sulfide, sodium hydroxide, and water with a first oxygen-rich gas stream in a first reaction zone at a temperature between about 180° F. and about 325° F. utilizing an oxygen supply rate and residence time sufficient to convert at least 80% of said sodium sulfide into one or more partially oxidized sulfur compounds and form a partially oxidized white liquor, wherein the molar ratio of oxygen in said first oxygen-rich gas stream to sodium sulfide in said white liquor feed stream is between about 1.0 and about 1.3;

(b) withdrawing a portion of said partially oxidized white liquor from said first reaction zone as a partially oxidized white liquor product comprising said one or more partially oxidized sulfur compounds;

(c) contacting the remainder of said partially oxidized white liquor with a second oxygen-rich gas stream in a second reaction zone at a temperature between about 300° F. and about 380° F. utilizing an oxygen supply rate and residence time sufficient to convert at least 80% of all unoxidized and partially oxidized sulfur compounds contained therein into sodium sulfate, wherein the molar ratio of oxygen in said second oxygen-rich gas stream to sodium sulfide in said white liquor feed stream is between about 1.0 and about 1.3; and (d) withdrawing from said second reaction zone a fully oxidized white liquor product.

2. The method of claim 1 wherein said first and second oxygen-rich gas streams contain at least 80 vol % oxygen.

3. The method of claim 1 wherein the pressures in said first and second reaction zones are in the range of about 20 to 300 psig.

4. The method of claim 1 which further comprises utilizing one or more portions of said fully oxidized white liquor product as alkali sources for one or more process steps in said pulp mill, wherein said steps are selected from the group consisting of oxygen delignification, alkali extraction (E), oxygen alkali extraction ($E_o$), peroxide-enhanced alkali extraction ($E_p$), peroxide-enhanced oxidative extraction ($E_{op}$), peroxide bleaching, hypochlorite bleaching, ozone bleaching, chlorine dioxide bleaching, and production of sodium hypochlorite.

5. The method of claim 4 which further comprises utilizing one or more portions of said partially oxidized white liquor product as alkali sources for one or more process steps in said pulp mill, wherein said steps are selected from the group consisting of oxygen delignification, alkali extraction (E), oxygen alkali extraction ($E_o$), gas scrubbing, removal of chlorine and chlorine dioxide from bleach plant effluents, regeneration of ion exchange columns, and the neutralization of acidic streams.

* * * * *